US012196227B2

(12) United States Patent
Hellman et al.

(10) Patent No.: US 12,196,227 B2
(45) Date of Patent: Jan. 14, 2025

(54) PUMP

(71) Applicant: Spike Brewing LLC, Milwaukee, WI (US)

(72) Inventors: Adam J. Hellman, Glendale, WI (US); Ryan Scott Dauss, Milwaukee, WI (US)

(73) Assignee: Spike Brewing LLC, Milwaukee, WI (US)

( * ) Notice: Subject to any disclaimer, the term of this patent is extended or adjusted under 35 U.S.C. 154(b) by 0 days.

(21) Appl. No.: 18/163,538

(22) Filed: Feb. 2, 2023

(65) Prior Publication Data

US 2023/0250823 A1 Aug. 10, 2023

Related U.S. Application Data

(60) Provisional application No. 63/306,812, filed on Feb. 4, 2022.

(51) Int. Cl.
*F04D 9/00* (2006.01)
*F04D 29/46* (2006.01)
*F04D 29/62* (2006.01)

(52) U.S. Cl.
CPC ..... *F04D 9/006* (2013.01); *F04D 29/466* (2013.01); *F04D 29/628* (2013.01)

(58) Field of Classification Search
CPC ..... F04D 9/006; F04D 29/466; F04D 29/628; F04D 29/4293; F04D 27/02; F04D 13/06;
(Continued)

(56) References Cited

U.S. PATENT DOCUMENTS 1,711,902 A 5/1929 Fritz
1,936,066 A * 11/1933 Peterson ..... F04D 15/0011 415/178

(Continued)

FOREIGN PATENT DOCUMENTS

DE 102019202975 A1 * 9/2020
WO WO-2015070955 A1 * 5/2015 ..... F01P 5/10

OTHER PUBLICATIONS

Blichmann Engineering, RipTide Brewing Pump (Year: 2021).*

*Primary Examiner* — Courtney D Hienle
*Assistant Examiner* — Ryan C Clark
(74) *Attorney, Agent, or Firm* — Michael Best & Friedrich LLP

(57) ABSTRACT

A pump includes a motor housing configured to support a motor and a pump head coupled to the motor housing. The pump head includes an inlet configured to receive a fluid, an outlet in fluid communication with the inlet, and a bypass assembly configured to facilitate a path for fluid removal. The bypass assembly includes a bypass housing defining a channel in fluid communication with the inlet, a bypass vent in fluid communication with the channel, and a sealing member movably supported within the channel. The sealing member movable between a closed position where the sealing member blocks flow of the fluid from the inlet through the bypass vent and an open position where the inlet is fluidly connected to the bypass vent. An impeller positioned within the pump head and the bypass assembly is positioned downstream of the inlet and upstream of the impeller and the outlet.

20 Claims, 11 Drawing Sheets

(58) Field of Classification Search
CPC . F04D 15/001; B67D 1/10; B67D 2001/0093; B67D 2001/0094; B67D 2001/0097; B67D 1/0081
See application file for complete search history.

(56) References Cited

U.S. PATENT DOCUMENTS

| | | | | |
|---|---|---|---|---|
| 3,588,266 | A * | 6/1971 | John | F04D 9/00 417/199.2 |
| 3,915,394 | A | 10/1975 | Ferguson, Jr. | |
| 4,410,337 | A | 10/1983 | Gullichsen et al. | |
| 4,435,193 | A | 3/1984 | Gullichsen et al. | |
| 4,601,310 | A * | 7/1986 | Phillips | F16K 31/44 277/910 |
| 4,637,779 | A | 1/1987 | Sherman et al. | |
| 4,675,033 | A | 6/1987 | Fellman et al. | |
| 4,826,398 | A | 5/1989 | Gillichsen | |
| 4,834,547 | A | 5/1989 | Niskanen | |
| 4,877,424 | A | 10/1989 | Perkola et al. | |
| 4,971,519 | A | 11/1990 | Timperi et al. | |
| 4,981,413 | A | 1/1991 | Elonen et al. | |
| 5,019,136 | A | 5/1991 | Elonen et al. | |
| 5,039,320 | A | 8/1991 | Hoglund et al. | |
| 5,058,615 | A | 10/1991 | Timperi et al. | |
| 5,083,749 | A * | 1/1992 | Linderman | F16K 41/02 251/327 |
| 5,167,678 | A | 12/1992 | Elonen et al. | |
| 5,868,550 | A | 2/1999 | Howchin | |
| 6,206,632 | B1 | 3/2001 | Gallus | |
| 6,551,054 | B1 | 4/2003 | Peltonen et al. | |
| 6,619,910 | B1 | 9/2003 | Burgess | |
| 6,991,216 | B1 * | 1/2006 | Wilson | F16K 41/02 251/223 |
| 7,210,898 | B2 | 5/2007 | Hubbard et al. | |
| 8,151,694 | B2 * | 4/2012 | Jacobs | A47J 31/469 99/302 C |
| 9,759,217 | B2 | 9/2017 | Yokota et al. | |
| 9,909,593 | B2 | 3/2018 | Dieziger | |
| 10,087,946 | B2 | 10/2018 | Wylie | |
| 10,119,543 | B2 | 11/2018 | Khan et al. | |
| 10,487,835 | B1 | 11/2019 | Ciotola | |
| 11,122,929 | B2 | 9/2021 | Colonna et al. | |
| 11,168,693 | B2 | 11/2021 | Bevington | |
| 2009/0016901 | A1 * | 1/2009 | Morris, III | F04B 49/106 417/63 |
| 2016/0018018 | A1 * | 1/2016 | Blichmann | F16K 31/504 251/213 |
| 2018/0163727 | A1 | 6/2018 | McClaran | |
| 2021/0396240 | A1 | 12/2021 | Iacoponi et al. | |

* cited by examiner

PUMP

CROSS-REFERENCE TO RELATED APPLICATIONS

This application claims priority to U.S. Provisional Patent Application No. 63/306,812 filed on Feb. 4, 2022, the entire content of which is incorporated herein by reference.

FIELD OF THE DISCLOSURE

The present disclosure relates to a pump. More specifically, the disclosure relates to a pump for use in brewing and fermentation. The pump provides for easier priming. The pump also includes an impeller configured to cut up material in a fluid traveling though the pump to reduce a potential of plugging or clogging of the pump.

SUMMARY

The present disclosure discloses a pump including a motor housing configured to support a motor and a pump head coupled to the motor housing. The pump head including an inlet configured to receive a fluid, an outlet in fluid communication with the inlet, and a bypass assembly configured to facilitate a path for fluid removal. The bypass assembly including a bypass housing defining a channel in fluid communication with the inlet, a bypass vent in fluid communication with the channel, and a sealing member movably supported within the channel. The sealing member movable between a closed position where the sealing member blocks flow of the fluid from the inlet through the bypass vent and an open position where the inlet is fluidly connected to the bypass vent. An impeller positioned within the pump head. The impeller operably coupled to the motor such that the impeller is configured to rotate to facilitate operation of the pump. The bypass assembly is positioned downstream of the inlet and upstream of the impeller and the outlet.

In another aspect, the present disclosure discloses a pump including a motor housing configured to support a motor and a pump head coupled to the motor housing. The pump head including an inlet configured to receive a fluid, the inlet defining an inlet axis, an outlet in fluid communication with the inlet, and a bypass assembly configured to facilitate a path for fluid removal. The bypass assembly including a bypass housing defining a channel in fluid communication with the inlet, a bypass vent in fluid communication with the channel, and a sealing member movably supported within the channel. The sealing member movable along a bypass adjustment axis between a closed position where the sealing member blocks flow of fluid from the inlet through the bypass vent and an open position where the inlet is fluidly connected to the bypass vent. An impeller positioned within the pump head, the impeller operably coupled to the motor such that the impeller is configured to rotate to facilitate operation of the pump. The bypass adjustment axis is perpendicular to and intersects the inlet axis.

In another aspect, the present disclosure discloses a pump including a motor housing configured to support a motor and a pump head coupled to the motor housing. The pump head including an inlet configured to receive a fluid, an outlet in fluid communication with the inlet, a pump casing defining an internal wall that fluidly connects the inlet and the outlet. A bypass assembly configured to selectively facilitate a path for air and fluid removal. The bypass assembly including a bypass housing defining a channel in fluid communication with the inlet, a bypass vent in fluid communication with the channel, and a sealing member movably supported within the channel. The sealing member movable between a closed position where the sealing member blocks flow of fluid from the inlet through the bypass vent and an open position where the inlet is fluidly connected to the bypass vent. An impeller positioned within the pump head. The impeller operably coupled to the motor such that the impeller is configured to rotate to facilitate operation of the pump. The impeller includes a rib having a geometry that corresponds with the geometry of the internal wall of the pump casing, the rib configured to reduce the size of particulate or other material in the fluid traveling through the pump.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
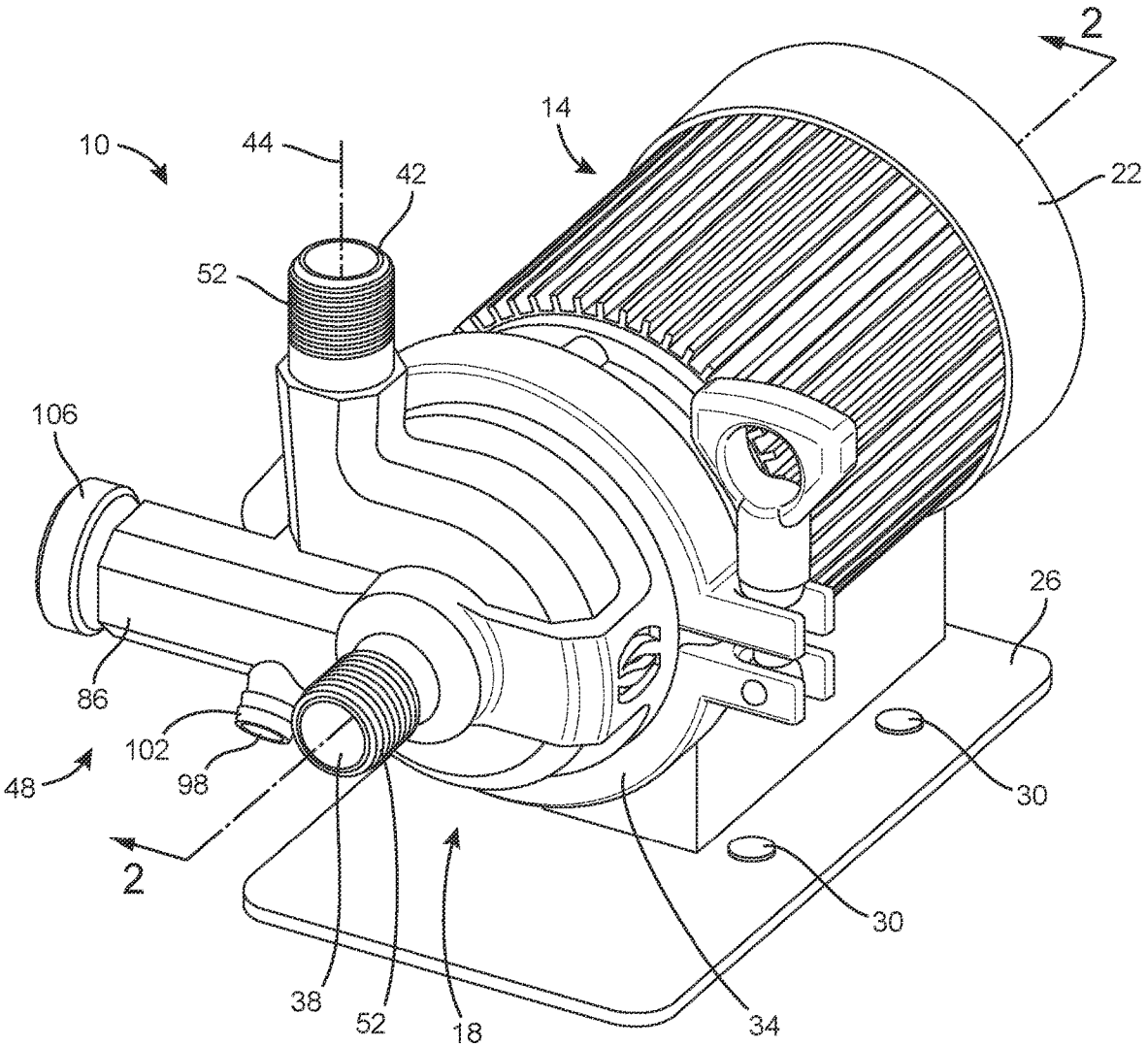
FIG. 1 is a perspective view of an example of an embodiment of a pump incorporating a bypass assembly and an improved impeller.
Figure 2:
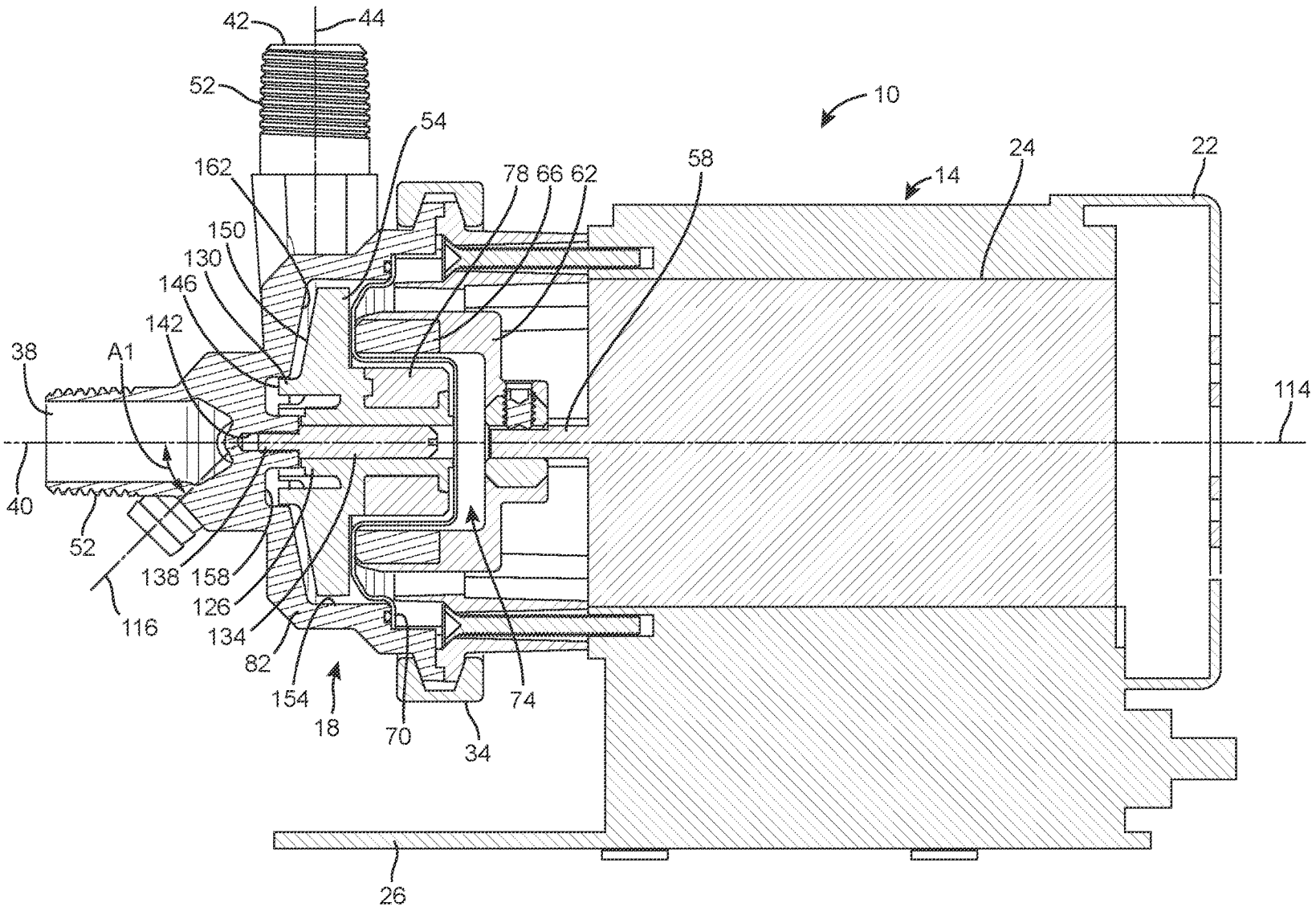
FIG. 2 is a cross-sectional view of the pump of FIG. 1 taken along line 2-2 of FIG. 1.

FIGS. 1 and 2 illustrates an example of an embodiment of a pump 10. The pump 10 includes a motor assembly 14 operably connected to a pump head 18. The motor assembly 14 includes a motor housing 22 that contains a motor 24 (FIG. 2). The motor housing 22 is coupled to a base 26. The base 26 is configured to be positioned on a surface (e.g., ground, floor, operating surface, etc.). The base 26 also defines a plurality of mounting apertures 30 to facilitate mounting of the pump 10 to something other than the surface (e.g., to a stand, wall, etc.). The pump head 18 is selectively coupled to the motor assembly by a fastener 34. In the illustrated embodiment, the fastener 34 is a tri-clamp fitting. In other examples of embodiments, the pump head 18 may be coupled to the motor using any suitable fastener(s) (e.g., bolts, screws, etc.).

The pump head 18 includes an inlet 38 defining an inlet axis 40, an outlet 42 defining an outlet axis 44, and a bypass assembly 48 (FIG. 5) defining a bypass adjustment axis 50. In the illustrated embodiment, the pump head 18 is a center inlet pump head, with the inlet 38 oriented perpendicularly to the outlet 42. In other words, the inlet axis 40 is perpendicular and offset the outlet axis 44. The bypass adjustment axis 50 is perpendicular to the inlet axis 40 and intersects the inlet axis 40. In other examples of embodiments, the pump head 18 can be an inline pump head, with the inlet and outlets oriented in parallel. The inlet 38 and the outlet 42 both include threads 52 to facilitate a threaded fitting (e.g., a National Pipe Taper (NPT) fitting, etc.). A hose (not shown) may be coupled to the inlet 38 and the outlet 42 (e.g., through connection with the threads 52) to transfer the liquid through the pump 10.

As illustrated in FIG. 2, an impeller 54 is positioned within the pump head 18. The impeller 54 is operably coupled to the motor 24 such that the impeller 54 is configured to rotate to facilitate operation of the centrifugal pump 10. In the illustrated embodiment, the pump 10 includes a magnetic connection between the impeller 54 and a motor shaft 58. As such, there is no physical contact connection between the impeller 54 and the motor shaft 58. A carrier 62 is coupled for rotation with the motor shaft 58. The carrier 62 defines a cavity 74 that is configured to the receive the impeller 54 and a first magnetic member 66 positioned proximate the cavity 74. A support housing 70 is coupled to the motor housing 22 and is positioned within the cavity 74 defined in the carrier 62. The impeller 54 is inserted within the support housing 70 and includes a second magnetic member 78 that is in magnetic communication with the first magnetic member 66. During operation of the pump 10, rotation of the motor shaft 58 and the carrier 62 rotates the impeller 54 through the magnetic connection between the first and second magnetic members 66, 78. In other embodiments, the impeller 54 may be coupled to the motor shaft 58 in other fashions (e.g., coupled via a fastener or the like).

Figure 3:
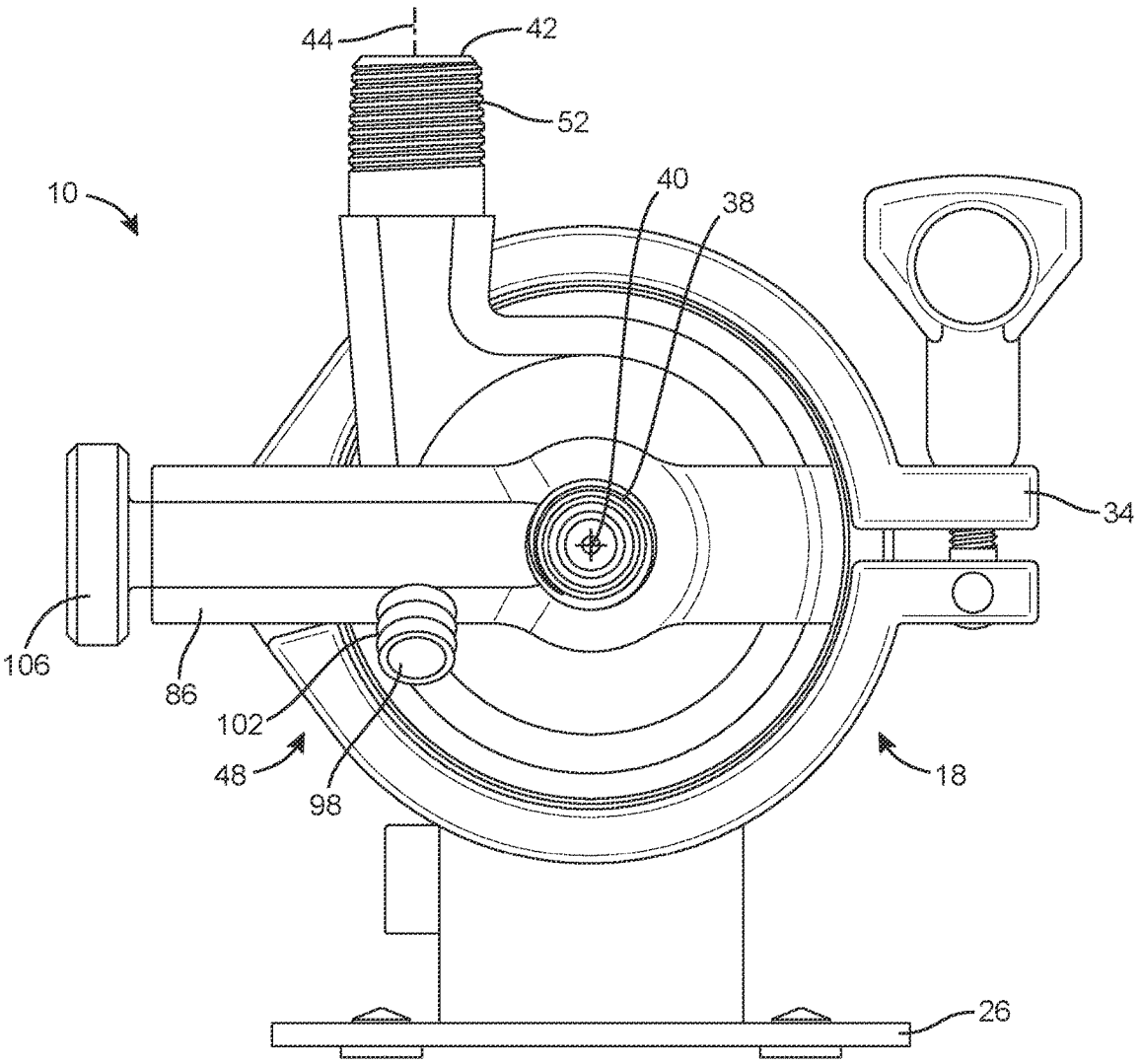
FIG. 3 is an end view of the pump of FIG. 1.

With reference now to FIGS. 1-3, the bypass assembly 48 is positioned downstream of the inlet 38, and upstream of the impeller 54 and the outlet 42. In the illustrated embodiment, the pump head 18 is a non-self-priming centrifugal pump. In order to prime the pump 10, fluid is introduced from the inlet 38 into a pump casing 82 defined by the pump head 18. In particular, the pump casing 82 defines an internal cavity of the pump head 18 and fluidly connects the inlet 38 and the outlet 42. Air is then expelled to avoid the pump 10 becoming air bound. To improve priming, the bypass assembly 48 selectively facilitates a path for air removal from the fluid being transferred through the pump 10. In other words, the bypass assembly 48 allows the user to release the air entrained within the fluid in the hose (not shown) coupled to the inlet 38 of the pump 10, which allows the user to prime the pump 10.

Figure 4:
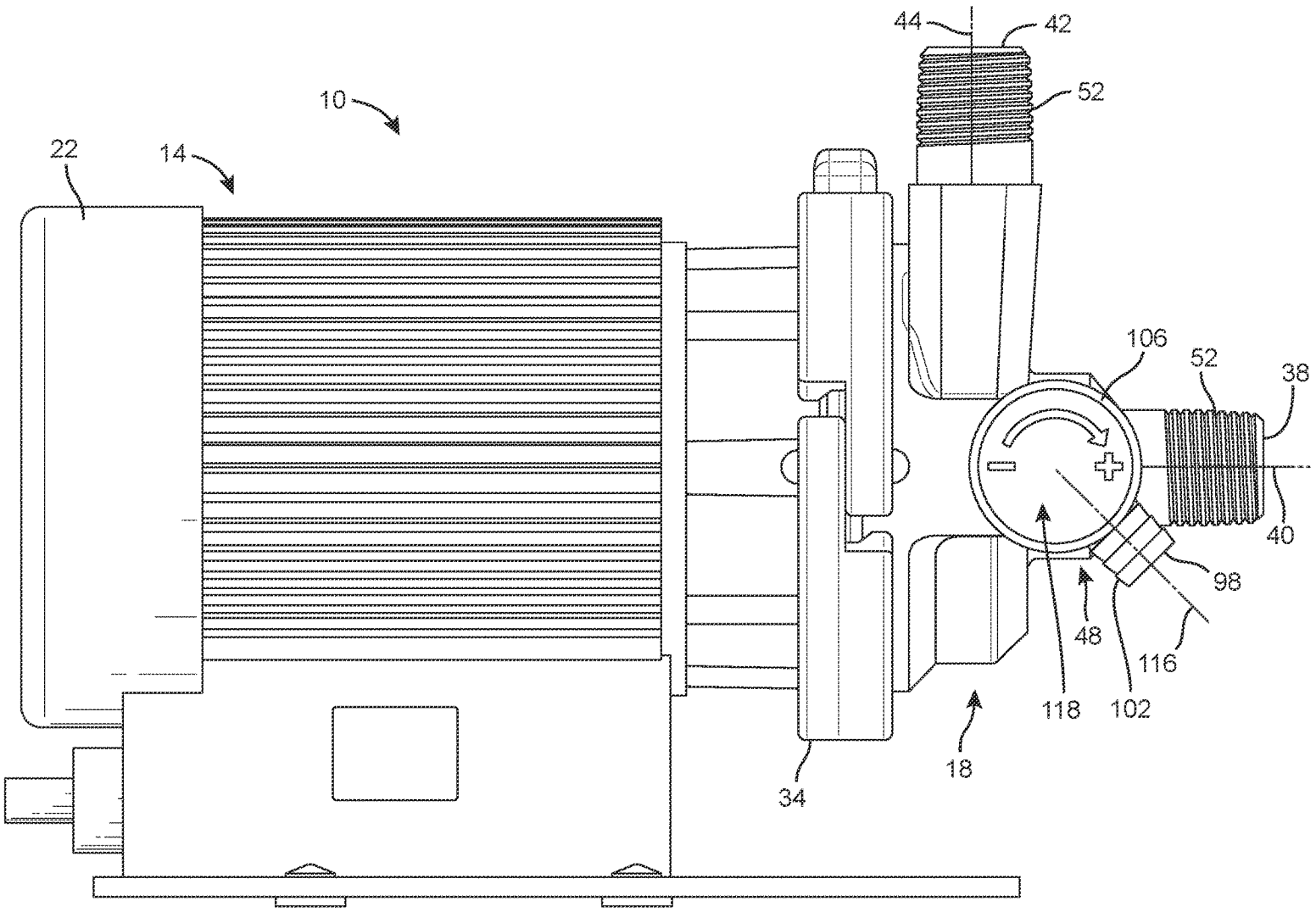
FIG. 4 is a side view of the pump of FIG. 1.
Figure 5:
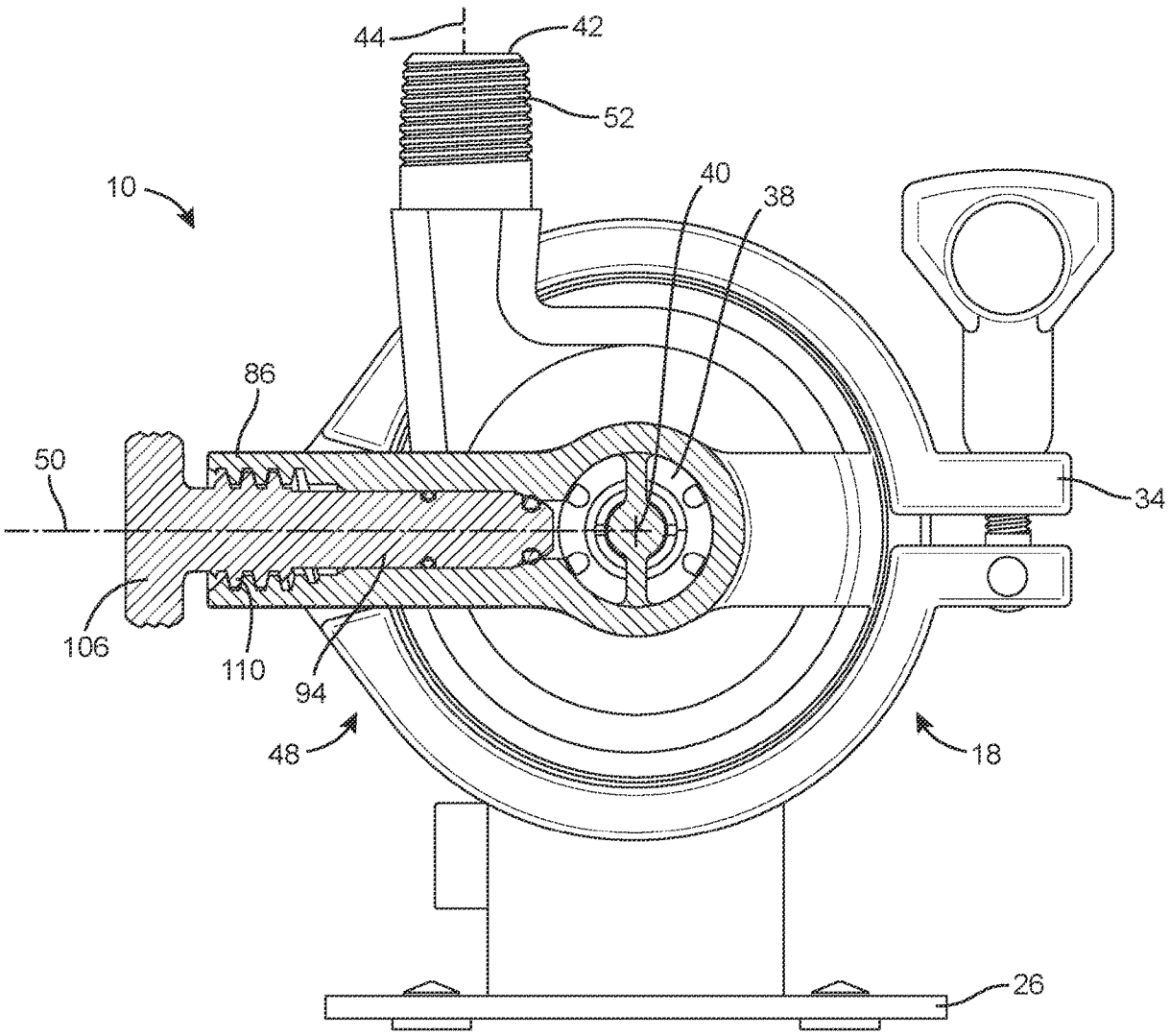
FIG. 5 is a partial cross-sectional view of the bypass assembly illustrating a sealing member and threads positioned within the bypass housing.
Figure 6:
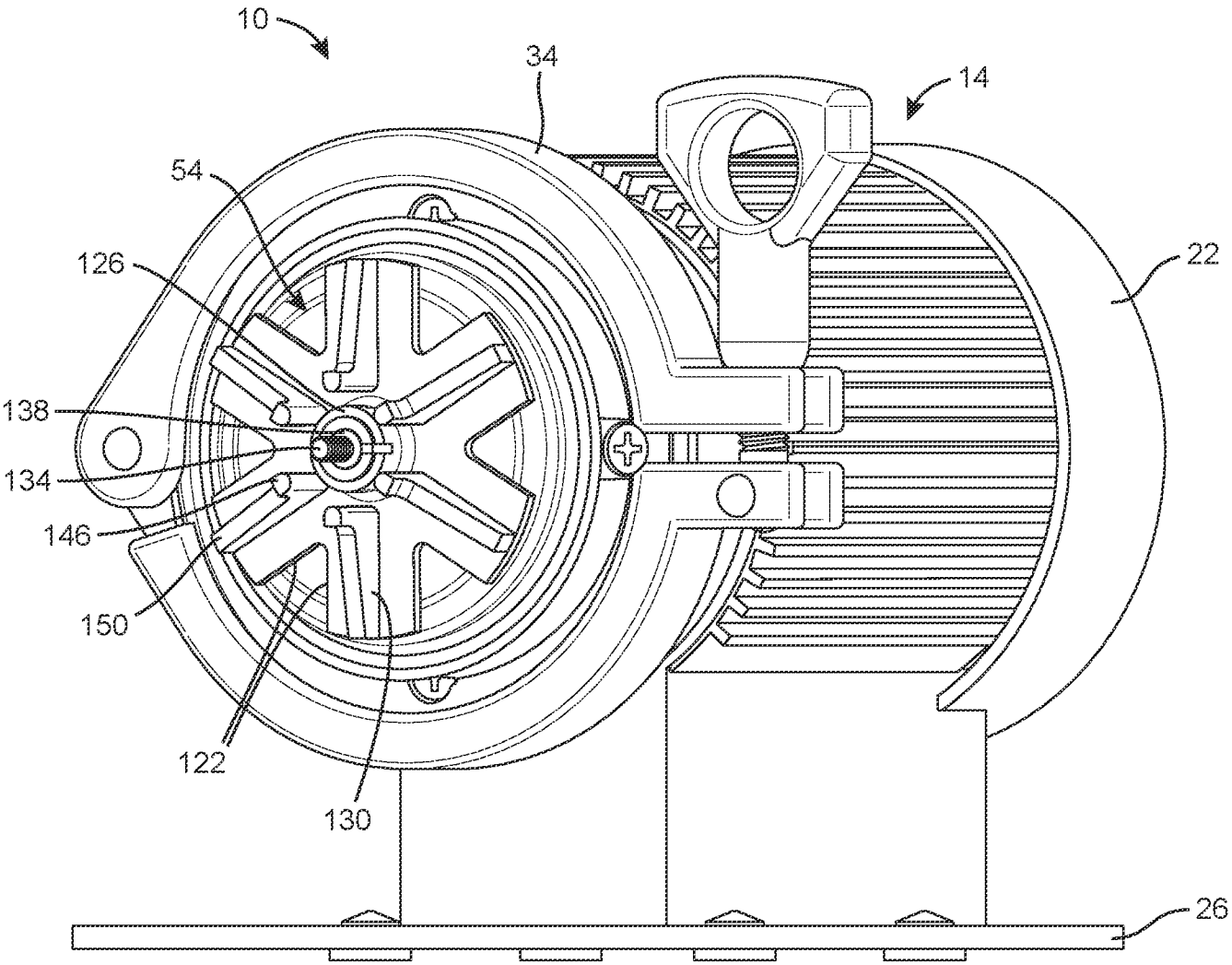
FIG. 6 is a perspective view of the pump of FIG. 1 with a pump casing removed to illustrate the improved impeller.
Figure 7:
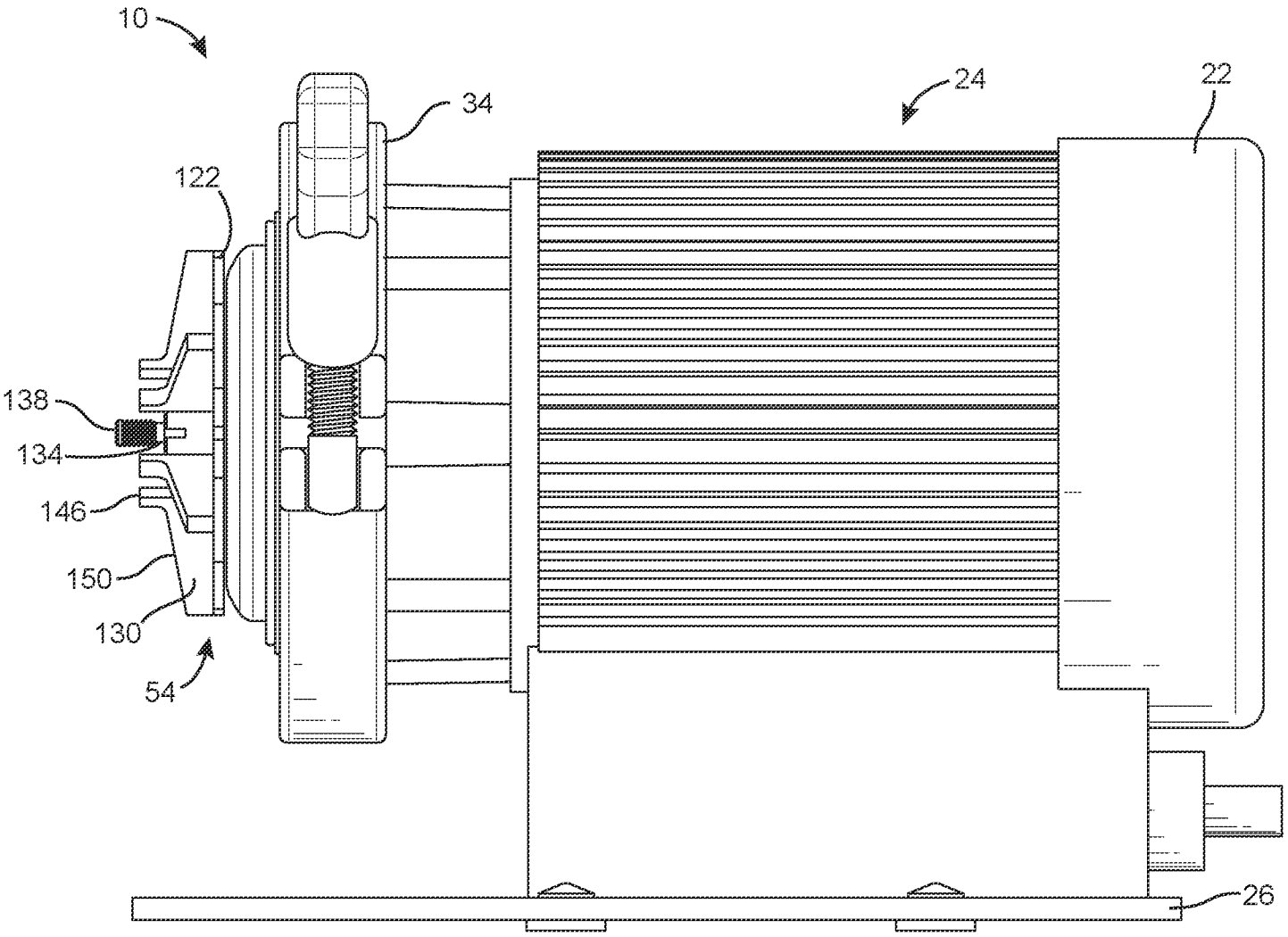
FIG. 7 is a side view of the pump of FIG. 6.
Figure 9:
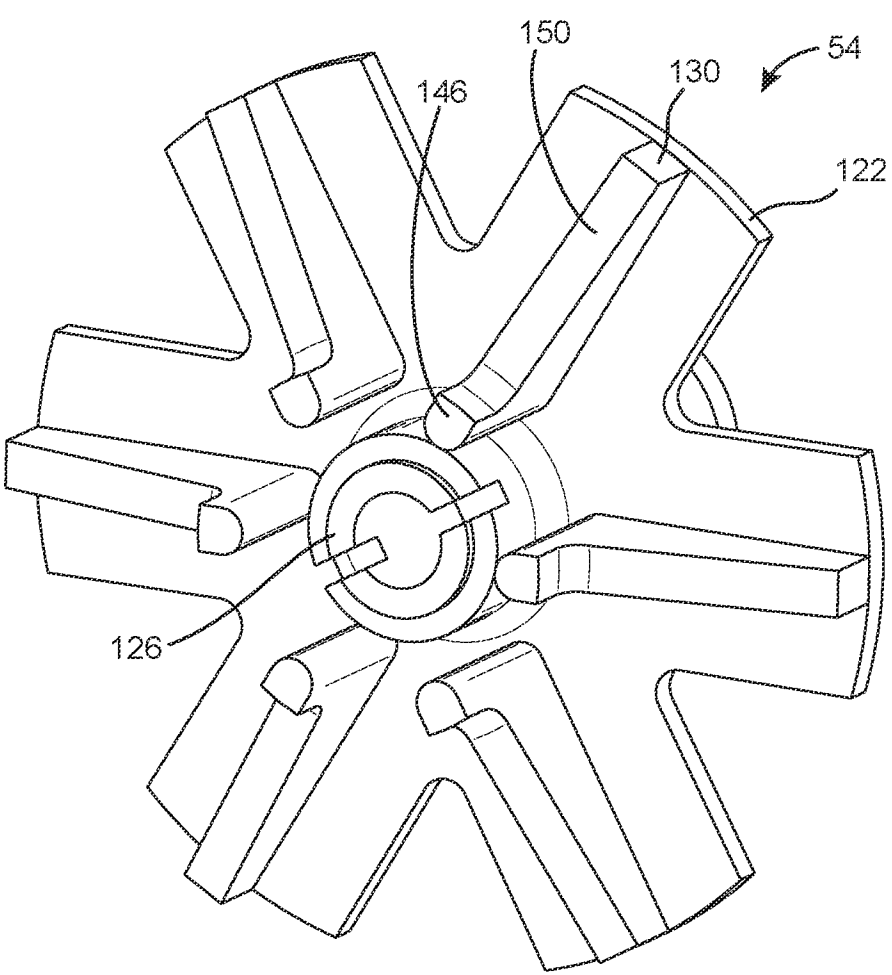
FIG. 9 is a perspective view of the improved impeller of FIG. 8.
Figure 8:
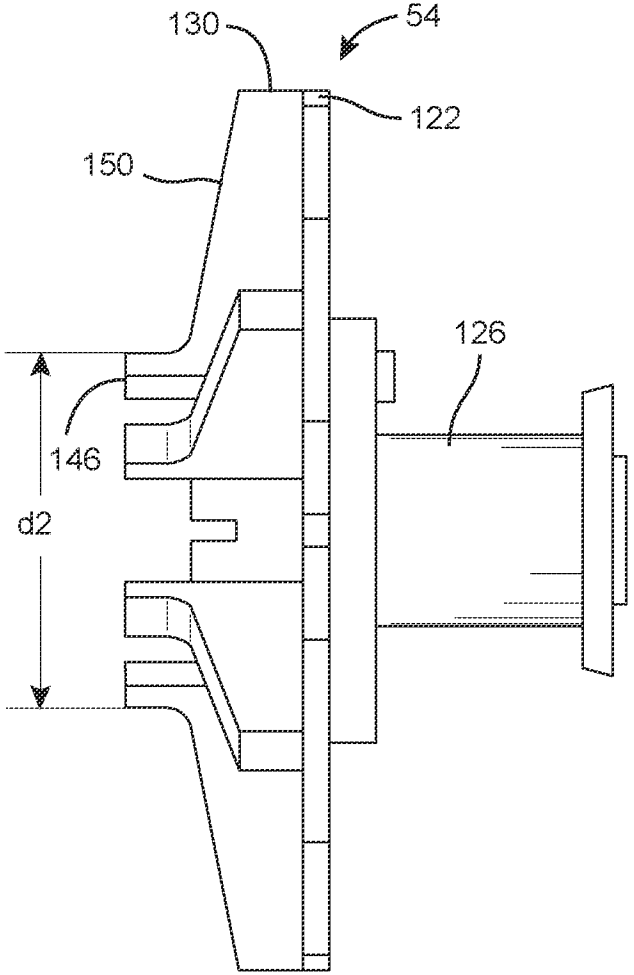
FIG. 8 is a side view of the improved impeller removed from the pump casing and detached from a motor.

With specific reference to FIGS. 3-5, the bypass assembly 48 includes a bypass housing 86 defining a channel 90 (FIG. 5), a sealing member 94 movable within the channel 90, and a bypass vent 98 in communication with the channel 90. The bypass housing 86 is positioned downstream of the inlet 38 and upstream of the impeller 54 (shown in FIG. 6) and the outlet 42. The bypass vent 98 extends outward from the bypass housing 86. In the illustrated embodiment, the bypass vent 98 is oriented towards the surface. This advantageously allows for fluid to be discharged through the bypass vent 98 towards the surface (such as the ground) in a direction away from a user. The bypass vent 98 also includes a plurality of barbs 102 positioned on an outer circumference. The barbs 102 allow for selective engagement with a hose (not shown) to direct fluid and/or air discharged through the bypass vent 98.

With reference now to FIG. 5, the sealing member 94 is connected to an adjustment dial 106 accessible externally of the bypass housing 86. The sealing member 94 also includes a plurality of threads 110 that are configured to engage a portion of the bypass housing 86. The sealing member 94 is configured to selectively facilitate (or block) a flow of fluid through the bypass assembly 48. In a first configuration of the bypass assembly 48, which is shown in FIG. 5, the sealing member 94 is positioned in a closed position. In this position, the sealing member 94 blocks flow of fluid and/or air from the inlet 38 to the bypass assembly 48. Accordingly, flow is restricted from exiting the pump casing 82 through the bypass vent 98. Flow instead travels from the inlet 38, into the pump casing 82, and is discharged through the outlet 42.

In a second configuration (not shown), the adjustment dial 106 is rotated relative to the bypass housing 86 in a first direction D1. In response to rotation of the adjustment dial 106 in the first direction, the threads 110 and sealing member 94 responsively rotate relative to the bypass housing 86. As the threads 110 rotate, the sealing member 94 laterally slides relative to the bypass housing 86 along the bypass adjustment axis 50. As the sealing member 94 laterally slides relative to the bypass housing 86 along the bypass adjustment axis 50 in a direction away from the impeller 54, the inlet 38 is fluidly connected to the bypass vent 98. Stated another way, the bypass vent 98 is opened. This facilitates a flow of fluid (e.g. liquid) and/or air from the inlet 38 to the bypass vent 98. Thus, a portion of the fluid and/or air flow is bypassed from entering the pump casing 82 and the outlet 42. Moving the sealing member 94 to the second configuration allows the user to prime the pump 10 by releasing air that may be built up in the hose (not shown) coupled to the inlet 38. In other words, it may be desirable to open the bypass vent 98 during priming of the pump 10. In some instances, the user may open the bypass vent 98 to collect a sample of the fluid being pumped.

To close the bypass valve (or transition from the second configuration to the first configuration), the adjustment dial 106 is rotated relative to the bypass housing 86 in a second direction D2 opposite the first direction D1. In response to rotation of the adjustment dial 106 in the second direction D2, the threads 110 and sealing member 94 responsively rotate relative to the bypass housing 86. As the threads 110 rotate, the sealing member 94 laterally slides relative to the bypass housing 86 along the adjustment axis 50 towards the impeller 54 and the inlet 38 until the fluid connection between the inlet 38 and the bypass vent 98 is closed (or terminated). Stated another way, the bypass vent 98 is closed. This terminates the flow of fluid and/or air from the inlet 38 to the bypass vent 98. It should be appreciated that while the sealing member 94 is threadably coupled to the bypass housing 86, that the sealing member 94 may be coupled to the bypass housing 86 in other fashions (e.g., spring biased, or the like).

Further, the positioning and orientation of the bypass assembly 48 allows the operator to sample or discharge fluid and/or air to a container (e.g., a bucket) without the fluid being under a large pressure created by the impeller 54 of the pump 10. In other words, the bypass vent 98 is positioned upstream the impeller 54, which is on a low pressure side of the pump 10. As such, the fluid is discharged from the bypass vent 98 without additional pressure. In contrast, if the bypass assembly 48 was positioned on a high pressure side (e.g., downstream the impeller 54) of the pump 10, the fluid would be discharged from the bypass vent 98 under a much greater pressure (e.g., with a greater velocity), which could create extensive and uncontrollable discharge of the fluid.

Further, the adjustment axis 50 is oriented transverse to the inlet axis 40 and an axis of rotation 114 of the impeller 54. In the illustrated embodiment, the adjustment axis 50 is oriented perpendicular to both the inlet axis 40 and the axis of rotation 114 of the impeller 54. A bypass vent axis 116 (FIG. 2) extends centrally through the bypass vent 98 and is positioned at an angle A1 relative to the axis of rotation 114 of the impeller 54 and the inlet axis 40. In the illustrated embodiment, the angle A1 is an acute angle.

As shown in FIG. 4, the adjustment dial 106 can include indicia 118 indicating a direction of rotation for the adjustment dial 106 to increase flow and to decrease (or terminate) flow through the bypass assembly 48. The indicia 118 indicates the first direction of rotation and a second direction of rotation. In the illustrated embodiment, the first direction of rotation is indicated with a plus, while the second direction of rotation is indicated with a minus. An arrow indicates the direction of the first direction of rotation.

With reference now to FIGS. 6-9, the impeller 54 of the pump 10 is illustrated in detail. The impeller 54 is configured to rotate to facilitate operation of the centrifugal pump 10. The impeller 54 includes a plurality of impeller fins 122. The impeller fins 122 radially extend outward from a central mounting portion 126. In the illustrated embodiment, the impeller 54 includes six fins. In other examples of embodiments, the impeller 54 can include five or fewer, or seven or more fins.

Each impeller fin 122 includes a rib 130. The ribs 130 project away from the fin 122. More specifically, each rib 130 generally extends perpendicularly from the associated fin 122. Each rib 130 is also generally positioned along a center of the impeller fin 122. Further, each rib 130 radially extends from the central mounting portion 126. It should be appreciated that the central mounting portion 126 defines the axis of rotation 114 of the impeller 54. It should also be appreciated that the central mounting portion 126 is configured to receive a mounting member 134 (shown in FIG. 7). The mounting member 134 includes a threaded end 138 that is configured to engage a mounting aperture 142 in the pump casing 82 (see FIG. 9) to mount the impeller 54 to the pump casing 82.

With reference now to FIGS. 6-9, each rib 130 includes a first projection portion 146 and a second sloped portion 150. The first projection portion 146 is positioned at a first end of the rib 130. The first projection portion 146 projects away from the impeller fin 122. Further, the first projection portion 146 projects in a direction generally parallel to the axis of rotation 114 of the impeller 54. The second sloped portion 150 extends from the first projection portion 146 to a second end of the rib 130 opposite the first end. In the illustrated embodiment, the second sloped portion 150 has a decreasing slope from the first projection portion 146 to the second end of the rib 130. However, at the second end of the rib 130, the second sloped portion 150 extends a distance away from the impeller fin 122.

Figure 10:
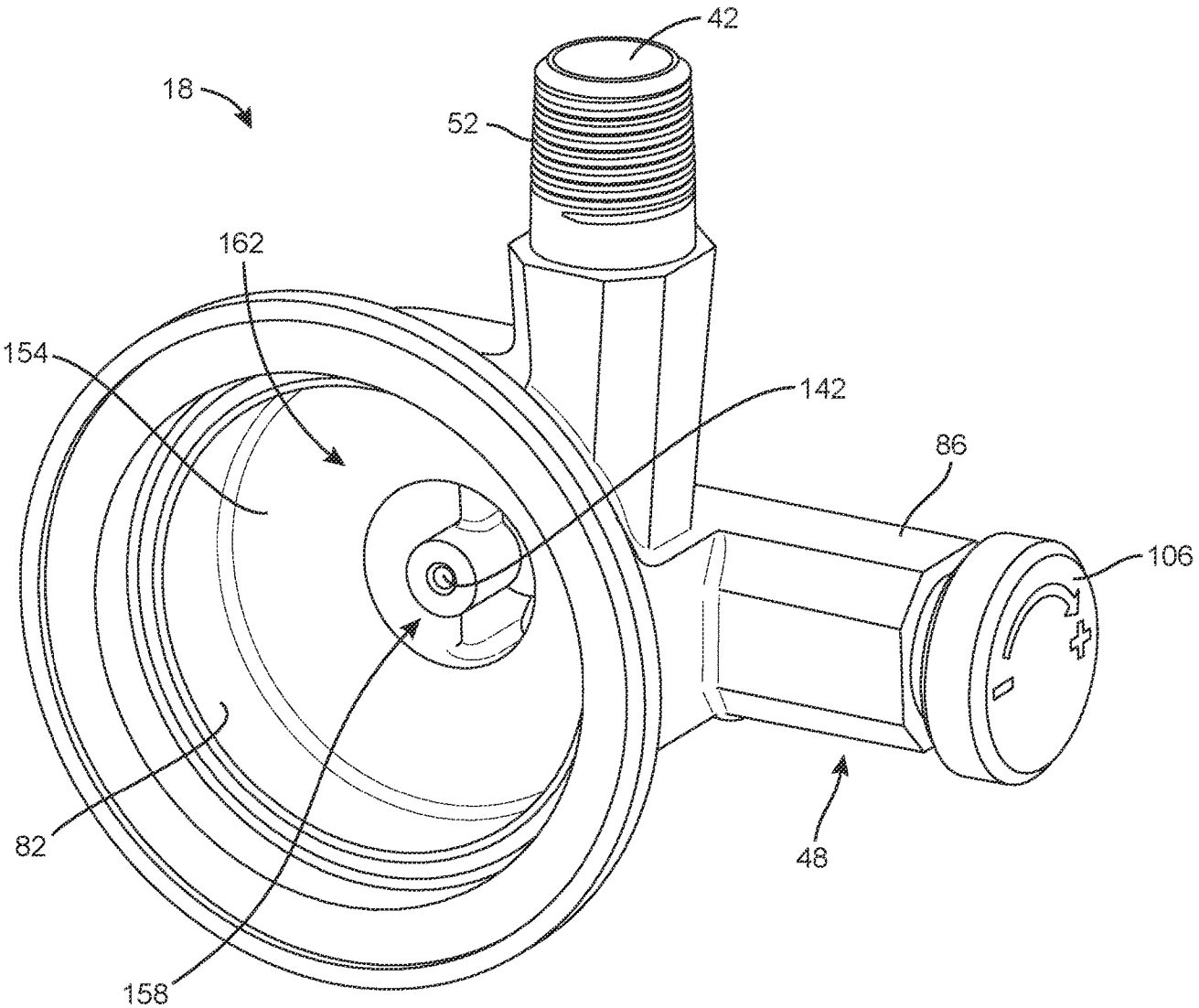
FIG. 10 is a perspective view of the pump casing for use with the pump of FIG. 1 illustrating a motor engagement end and with the impeller of FIG. 8 removed for clarity.
Figure 11:
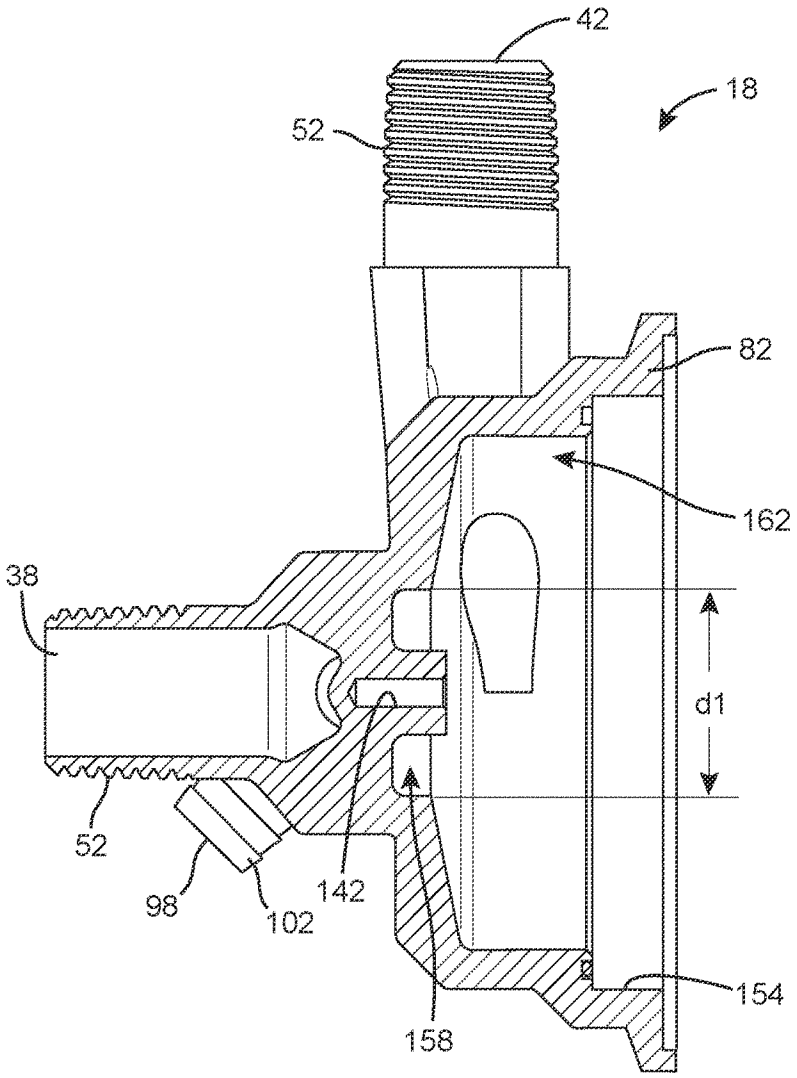
FIG. 11 is a cross-sectional view of the pump casing taken along line 10-10 of FIG. 2.

With reference now to FIGS. 10-11, the pump casing 82 includes an internal wall 154 that has a geometry complimentary to the plurality of ribs 130 on the impeller 54. The internal wall 154 includes a first portion of the wall 154 and a second portion of the wall 154. The first portion of the wall 154 defines a recess 158. In the illustrated embodiment, the first portion of the wall 154 defines an annular recess 158 that is located where the inlet 38 meets the internal wall 154 of the pump casing 82. The second portion of the wall 154 extends from the first portion of the wall 154 radially outward to a generally cylindrical portion 162 of the internal wall 154. The second portion of the wall 154 is generally sloped from the first portion of the wall 154 to the generally cylindrical portion 162 of the wall 154.

Now with reference to FIG. 2, the raised ribs 130 of the impeller 54 are oriented with a geometry that is complimentary to a geometry of the internal wall 154 of the pump casing 82. This allows the ribs 130 to chop, cut, or otherwise reduce the size of particulate or other material in the fluid traveling through the pump 10. In the illustrated embodiment, the first portion of the wall 154 is configured to receive the first projection portion 146 of each rib 130. Stated another way, the first projection portion 146 of each rib 130 is received by the recess 158 defined by the first portion of the wall 154. The second portion of the wall 154 is configured to have a slope that is complimentary to the slope of the second sloped portion 150 of each rib 130. The generally cylindrical portion 162 (shown in FIGS. 9-10) is configured to receive the impeller fins 122 (shown in FIGS. 5 and 8). The impeller fins 122 are configured to rotate around an inner circumference defined by the cylindrical portion 162 of the internal wall 154.

As the impeller 54 rotates within the pump casing 82 the ribs 130 interact with the geometry of the first and second portions of the internal wall 154 to chop, cut, or otherwise reduce the size of particulate or other material in the fluid traveling through the pump 10. The first projection portion 146 rotating in the recess 158 defined by the first portion of the internal wall 154 reduces the size of particulate or other material entering through the inlet 38. The second sloped portion 150 rotating relative to the second portion of the wall 154 further reduces the size of particulate or other material in the fluid. The reduced sized particulate or other material is then centrifugally discharged with the fluid towards to the outlet and/or bypass assembly.

In the illustrated embodiment, the annular recess defines a first diameter d1 (FIG. 11) and second diameter d2 (FIG. 8) is defined between an outer portion of the first projection portions 146. The second diameter d2 is less than the first diameter d1 such that a clearance is defined between the outer portion of the first projection portion 146 and the internal wall 154 defined by the annular recess. For example, the clearance between the second sloped portion 150 and the second portion of the wall 154 is such that particulate or other material are further reduced in size. In the illustrated embodiment, the clearance is in a range from 0.01 inch to 0.04 inch. The clearance between the first projection portion 146 and the recess 158 provides the space for the particulate to be chopped or cut. Further, the internal wall 154 is positioned at an oblique angle relative to the first projection portion 146 of the impeller 54 to direct the particulate towards the first projection portion 146.

As a nonlimiting example, when the pump 10 is used in association with brewing of beer, particulate can be within wort. The particulate can include grain or other grist material when the pump 10 is used during the mashing process or lautering process, or hops (e.g., whole leaf, pellet, etc.) when the pump 10 is used during the whirlpool process or during transfer from a boil kettle to a fermenter. The ribs 130 provide shear force while also minimizing a flow path between the impeller 54 and the associated internal wall 126 of the pump casing downstream of the inlet 38 and upstream of the outlet 42. This reduces the size of the particulate, leading to a reduced risk of plugging or clogging of the pump 10, or in the outlet line connected to the outlet 42 of the pump 10.

Figure 12:
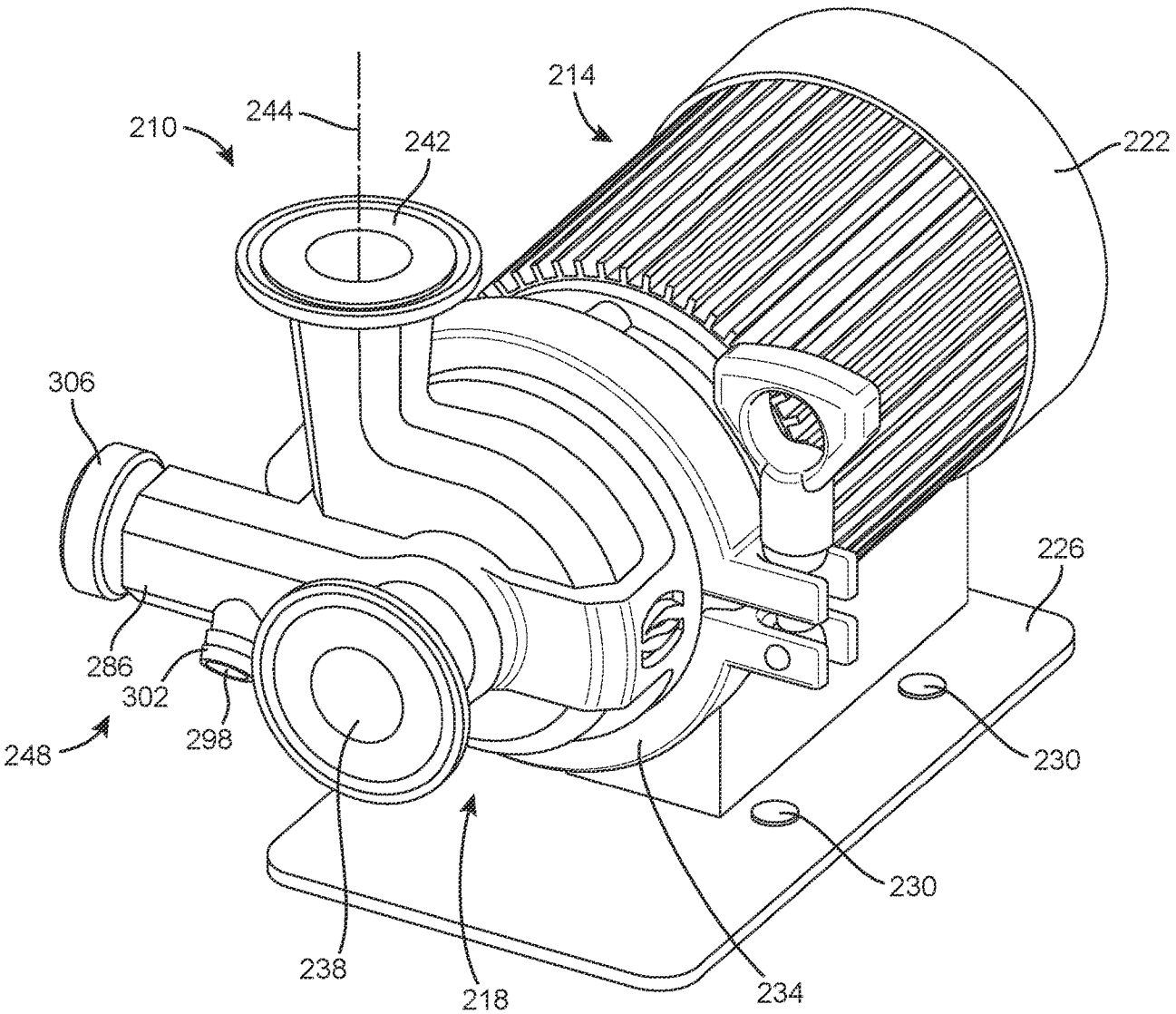
FIG. 12 is a perspective view of another example of an embodiment of a pump incorporating the bypass assembly and the improved impeller.

With reference now to FIG. 12, another example of an embodiment of a pump 210 is illustrated. The pump 210 shown in FIG. 12 is substantially the same as the pump 10 shown in FIG. 1 with like features numbers with similar reference plus "200". The main difference is the inlet and the outlet both include tri-clamp connections (or tri-clamp fitting). More specifically, both the inlet and the outlet includes a flange configured to form one-half of a tri-clamp connection. Each flange includes an annular groove that is configured to receive a seal member. The pump shown in FIG. 12 otherwise includes the bypass assembly and impeller described above in association with FIG. 1.

Although the invention has been described in detail with reference to certain preferred embodiments, variations and modifications exist within the scope and spirit of one or more independent aspects of the invention as described.

What is claimed is:

1. A pump comprising:
a motor housing configured to support a motor;
a pump head coupled to the motor housing, the pump head including
an inlet configured to receive a fluid,
an outlet in fluid communication with the inlet, and
a bypass assembly configured to facilitate a path for fluid removal, the bypass assembly including
a bypass housing defining a channel in fluid communication with the inlet,
a bypass vent in fluid communication with the channel, and
a sealing member movably supported within the channel, the sealing member movable between a closed position where the sealing member blocks flow of the fluid from the inlet through the bypass vent and an open position
where the inlet is fluidly connected to the bypass vent, and
an impeller positioned within the pump head, the impeller operably coupled to the motor such that the impeller is configured to rotate to facilitate operation of the pump,
wherein the bypass assembly is positioned downstream of the inlet and upstream of the impeller and the outlet.

2. The pump of claim 1, wherein the fluid includes a liquid with air entrained within the liquid, and wherein the air entrained within the liquid is released from the bypass vent when the sealing member is moved to the open position to prime the pump.

3. The pump of claim 1, wherein the sealing member is connected to an adjustment dial accessible externally of the bypass housing.

4. The pump of claim 3, wherein the sealing member includes a plurality of threads that are configured to engage a portion of the bypass housing, and wherein rotation of adjustment dial rotates the sealing member to facilitate adjustment between the open and closed positions.

5. The pump of claim 1, wherein
an inlet axis extends centrally through the inlet,
the sealing member laterally slides relative to the bypass housing along a bypass adjustment axis when the sealing member is moved between the open and closed positions, and
the bypass adjustment axis is perpendicular to and intersects the inlet axis.

6. The pump of claim 5, wherein
the impeller includes a central mounting portion and a plurality of fins,
the central mounting portion defines an axis of rotation of the impeller, and
the bypass adjustment axis is perpendicular to the axis of rotation.

7. The pump of claim 6, wherein a bypass vent axis extends centrally through the bypass vent and is positioned at an acute angle relative to the axis of rotation of the impeller and the inlet axis.

8. The pump of claim 1, wherein
the motor includes a motor shaft,
a carrier is coupled for rotation with the motor shaft,
the carrier defines a cavity that is configured to the receive the impeller and a first magnetic member positioned proximate the cavity, and
the impeller includes a second magnetic member that is in magnetic communication with the first magnetic member.

9. A pump comprising:
a motor housing configured to support a motor;
a pump head coupled to the motor housing, the pump head including
an inlet configured to receive a fluid,
an outlet in fluid communication with the inlet, and
a bypass assembly configured to facilitate a path for fluid removal, the bypass assembly including
a bypass vent, and
a sealing member movable between a closed position where the sealing member blocks flow of the fluid from the inlet through the bypass vent and an open position where the inlet is fluidly connected to the bypass vent, and
an impeller positioned within the pump head, the impeller operably coupled to the motor such that the impeller is configured to rotate to facilitate operation of the pump,
wherein the bypass assembly is positioned downstream of the inlet and upstream of the impeller and the outlet.

10. The pump of claim 9, wherein the fluid includes a liquid with air entrained within the liquid, and wherein the air entrained within the liquid is released from the bypass vent when the sealing member is moved to the open position to prime the pump.

11. The pump of claim 9, wherein the sealing member is connected to an adjustment dial accessible externally of the pump head.

12. The pump of claim 11, wherein the sealing member includes a plurality of threads that are configured to engage a portion of the pump head, and wherein rotation of adjustment dial rotates the sealing member to facilitate adjustment between the open and closed positions.

13. The pump of claim 9, wherein
an inlet axis extends centrally through the inlet,
the sealing member laterally slides relative to the pump head along a bypass adjustment axis when the sealing member is moved between the open and closed positions, and
the bypass adjustment axis is perpendicular to the inlet axis.

14. The pump of claim 13, wherein the impeller includes a central mounting portion and a plurality of fins, the central mounting portion defines an axis of rotation of the impeller, and the bypass adjustment axis is perpendicular to the axis of rotation.

15. The pump of claim 14, wherein a bypass vent axis extends centrally through the bypass vent and is positioned at an acute angle relative to the axis of rotation of the impeller and the inlet axis.

16. The pump of claim 9, wherein the motor includes a motor shaft, a carrier is coupled for rotation with the motor shaft, the carrier defines a cavity that is configured to the receive the impeller and a first magnetic member positioned proximate the cavity, and the impeller includes a second magnetic member that is in magnetic communication with the first magnetic member.

17. A pump comprising:

a motor housing configured to support a motor;

a pump head coupled to the motor housing, the pump head including an inlet configured to receive a fluid, an outlet in fluid communication with the inlet, and a bypass assembly configured to facilitate a path for fluid removal, the bypass assembly positioned downstream of the inlet and upstream of the outlet, the bypass assembly including a bypass vent, and a sealing member movable between a closed position and an open position, wherein in response to the sealing member being in the closed position, the fluid from the inlet is restricted from flowing through the bypass vent, and wherein in response to the sealing member being in the open position, the fluid from the inlet is configured to flow through the bypass vent, and an impeller positioned within the pump head downstream the bypass assembly, the impeller operably coupled to the motor such that the impeller is configured to rotate to facilitate operation of the pump.

18. The pump of claim 17, wherein the sealing member is connected to an adjustment dial accessible externally of the pump head.

19. The pump of claim 18, wherein the sealing member includes a plurality of threads that are configured to engage a portion of the pump head, and wherein rotation of adjustment dial rotates the sealing member to facilitate adjustment between the open and closed positions.

20. The pump of claim 17, wherein an inlet axis extends centrally through the inlet, the sealing member laterally slides relative to the pump head along a bypass adjustment axis when the sealing member is moved between the open and closed positions, and the bypass adjustment axis is perpendicular to the inlet axis.

* * * * *